US007168438B2

(12) United States Patent
Hung

(10) Patent No.: US 7,168,438 B2
(45) Date of Patent: Jan. 30, 2007

(54) CONTROL DEVICE FOR OPENING AND CLOSING AUTOMATIC UMBRELLA

(76) Inventor: Hsi-Lu Hung, No. 202, Huei Nan Rd., Her Mei Town, Changhua Hsien (TW)

( * ) Notice: Subject to any disclaimer, the term of this patent is extended or adjusted under 35 U.S.C. 154(b) by 180 days.

(21) Appl. No.: 10/935,668

(22) Filed: Sep. 7, 2004

(65) Prior Publication Data

US 2006/0048806 A1 Mar. 9, 2006

(51) Int. Cl.
*A45B 25/14* (2006.01)

(52) U.S. Cl. ..... 135/24; 135/22; 135/25.1; 135/25.4

(58) Field of Classification Search ..... 135/22, 135/24, 28, 25.1, 38, 41, 25.4; 74/551.8, 74/551.9

See application file for complete search history.

(56) References Cited

U.S. PATENT DOCUMENTS 5,267,583 A * 12/1993 Wu ..... 135/24
5,361,792 A * 11/1994 Lin et al. ..... 135/24
5,626,161 A * 5/1997 Lin et al. ..... 135/24
5,740,823 A * 4/1998 Lin et al. ..... 135/24
5,823,215 A * 10/1998 Chou et al. ..... 135/24
6,170,498 B1 * 1/2001 Wu ..... 135/24
6,196,243 B1 * 3/2001 Chen ..... 135/22
6,257,257 B1 * 7/2001 Shih ..... 135/24
6,684,893 B1 * 2/2004 Kuo ..... 135/24
2006/0032523 A1 * 2/2006 Chou ..... 135/24

* cited by examiner

*Primary Examiner*—Winnie Yip
(74) *Attorney, Agent, or Firm*—Alam D. Kamrath; Nikolai & Mersereau, P.A.

(57) ABSTRACT

A control device for opening and closing an automatic umbrella includes a handle, a lower tube, a control member, a press plate, a bullet head, an upper tube, and a push button. Thus, the push button is pressed in a two-stage manner to push and pivot the press plate to open and close the umbrella automatically, so that the control device is operated easily and conveniently, thereby facilitating a user opening and closing the umbrella.

13 Claims, 5 Drawing Sheets

CONTROL DEVICE FOR OPENING AND CLOSING AUTOMATIC UMBRELLA

BACKGROUND OF THE INVENTION

1. Field of the Invention

The present invention relates to a control device and, more particularly, to a control device for opening and closing an automatic umbrella.

2. Description of the Related Art

A conventional umbrella used outdoors comprises an upright rod, a skeleton pivotally mounted on the upright rod, and a canopy mounted on the upright rod and rested on the skeleton. However, the skeleton usually has a larger volume with a heavier weight, so that a user needs to exert a larger force to drive the skeleton to move on the upright rod to expand or collapse the canopy so as to open or close the umbrella, thereby wasting the user's manual work and energy. In addition, the conventional umbrella is not opened and closed easily and conveniently, thereby causing inconvenience to the user when opening or closing the umbrella.

SUMMARY OF THE INVENTION

In accordance with the present invention, there is provided a control device, comprising a handle, a lower tube, a control member, a press plate, a bullet head, an upper tube, and a push button, wherein:

the handle has a peripheral wall formed with a through hole;

the lower tube is mounted in the handle and has a peripheral wall formed with a through hole aligning with the through hole of the handle;

the control member is mounted in the lower tube and has an inside formed with a chamber having a peripheral wall formed with a locking hole aligning with the through hole of the lower tube;

the bullet head is movably mounted in the control member and the lower tube and has a lower end formed with a locking portion detachably locked in the locking hole of the chamber of the control member;

the upper tube is movably mounted on the lower tube and has a lower end aligning with the locking hole of the chamber of the control member;

the press plate is pivotally mounted on the control member and has a first end protruded outward from the through hole of the lower tube and rested on the lower end of the upper tube;

the push button is movably mounted on the handle and has an inner wall formed with a push block rested on the first end of the press plate.

The primary objective of the present invention is to provide a control device for opening and closing an automatic umbrella.

Another objective of the present invention is to provide a control device, wherein the push button is pressed in a two-stage manner to push and pivot the press plate to open and close the umbrella automatically, so that the control device is operated easily and conveniently, thereby facilitating a user opening and closing the umbrella.

A further objective of the present invention is to provide a control device, wherein the push button functions to both open and close the umbrella automatically, thereby facilitating the user operating the control device to open and close the umbrella.

A further objective of the present invention is to provide a control device, wherein the first elastic plate is urged on the locking portion of the bullet head to press the locking portion of the bullet head toward the locking hole of the chamber of the control member, so that the locking portion of the bullet head is locked in the locking hole of the chamber of the control member rigidly and stably.

Further benefits and advantages of the present invention will become apparent after a careful reading of the detailed description with appropriate reference to the accompanying drawings.

DETAILED DESCRIPTION OF THE INVENTION

Figure 1:
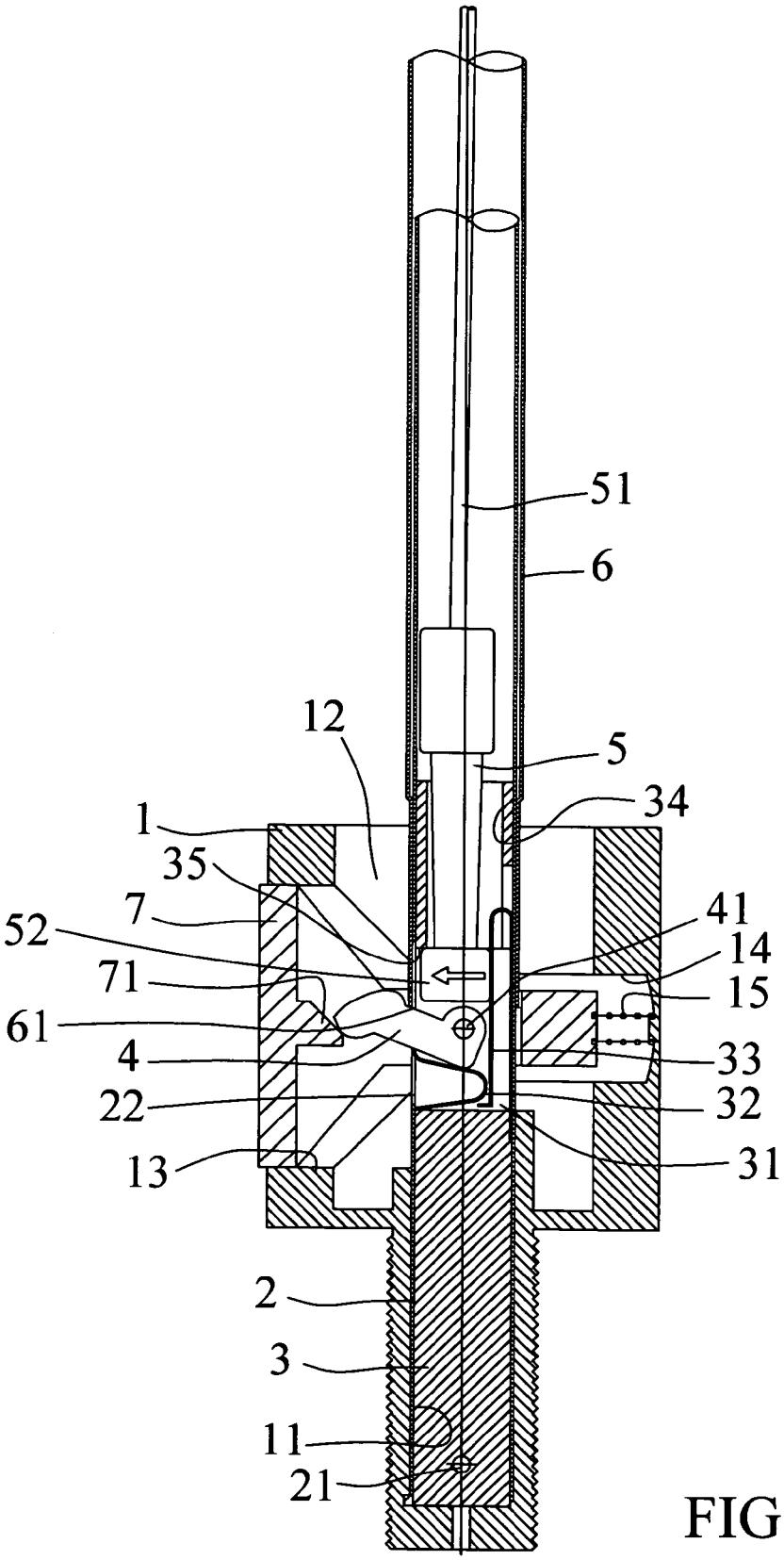
FIG. 1 is a plan cross-sectional assembly view of a control device in accordance with the preferred embodiment of the present invention.
Figure 1A:
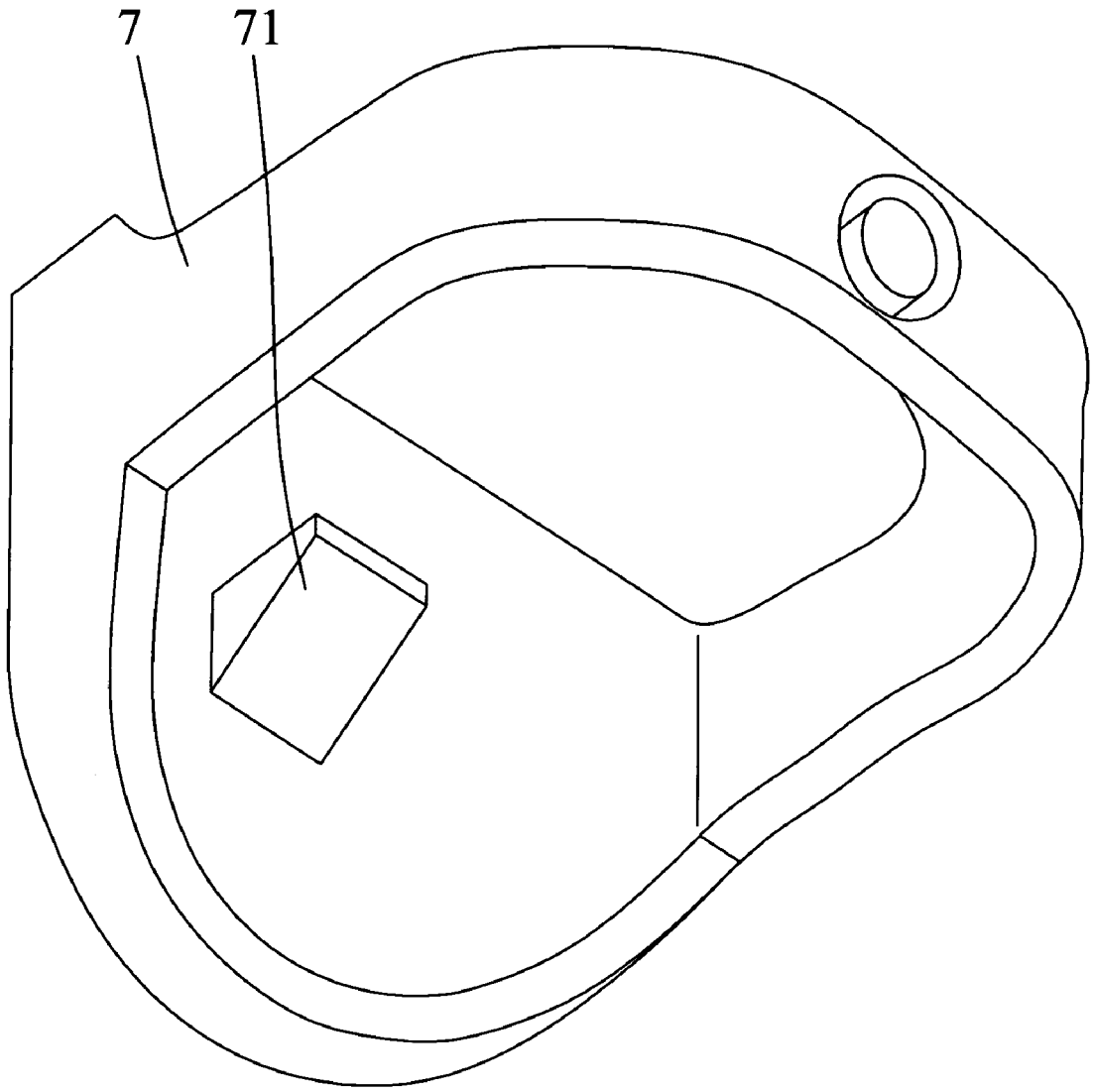
FIG. 1A is a perspective view of a push button of the control device as shown in FIG. 1.

Referring to the drawings and initially to FIGS. 1 and 1A, a control device for opening and closing an automatic umbrella in accordance with the preferred embodiment of the present invention comprises a handle 1, a lower tube 2, a control member 3, a press plate 4, a bullet head 5, an upper tube 6, and a push button 7.

The handle 1 has a peripheral wall formed with a through hole 13 and a recess 14 located opposite to the through hole 13. The handle 1 has an upper end formed with a mounting hole 12 and a lower end formed with an insertion hole 11.

The lower tube 2 is mounted in the handle 1 and has a peripheral wall formed with a through hole 22 aligning with the through hole 13 of the handle 1. The lower tube 2 has an upper end mounted in and protruded from the mounting hole 12 of the handle 1 and a lower end inserted into the insertion hole 11 of the handle 1.

The control member 3 is mounted in the lower tube 2 and has an inside formed with a chamber 31 having a peripheral wall formed with a locking hole 35 aligning with the through hole 22 of the lower tube 2. The chamber 31 of the control member 3 is aligning with the through hole 22 of the lower tube 2 and has an upper end formed with a guide hole 34.

A fixing rod 21 is extended through the lower end of the handle 1, the lower end of the lower tube 2 and a lower end of the control member 3 to combine the handle 1, the lower tube 2 and the control member 3.

The bullet head 5 is movably mounted in the control member 3 and the lower tube 2 and has a lower end formed with a locking portion 52 detachably locked in the locking hole 35 of the chamber 31 of the control member 3. A pull wire 51 is extended through the upper tube 6 and the lower tube 2 and has a lower end secured on an upper end of the bullet head 5 to pull the bullet head 5 upward. The bullet head 5 is moved through the guide hole 34 into the chamber 31 of the control member 3.

A first elastic plate 33 is mounted in the chamber 31 of the control member 3 and urged on the locking portion 52 of the bullet head 5 to press the locking portion 52 of the bullet head 5 toward the locking hole 35 of the chamber 31 of the control member 3.

The upper tube 6 is movably mounted on the lower tube 2 and has a lower end 61 aligning with the locking hole 35 of the chamber 31 of the control member 3.

The press plate 4 is pivotally mounted on the control member 3 and has a first end protruded outward from the through hole 22 of the lower tube 2 and rested on the lower end 61 of the upper tube 6 and a second end pivotally mounted in the chamber 31 of the control member 3 by a pivot shaft 41. The first end of the press plate 4 is extended through the locking hole 35 of the chamber 31 of the control member 3 and the through hole 22 of the lower tube 2 and extended into the mounting hole 12 of the handle 1.

A second elastic plate 32 is mounted in the chamber 31 of the control member 3 and urged on the first end of the press plate 4 to push the first end of the press plate 4 upward toward the lower end 61 of the upper tube 6 and the locking portion 52 of the bullet head 5.

The push button 7 is movably mounted on the handle 1 and has an inner wall formed with a wedge-shaped push block 71 rested on the first end of the press plate 4. The push button 7 is movably mounted in the through hole 13 of the handle 1 and limited by the lower tube 2. A restoring member 15 is mounted in the recess 14 of the handle 1 and biased between an outer wall of the push button 7 and the peripheral wall of the handle 1.

Figure 2:
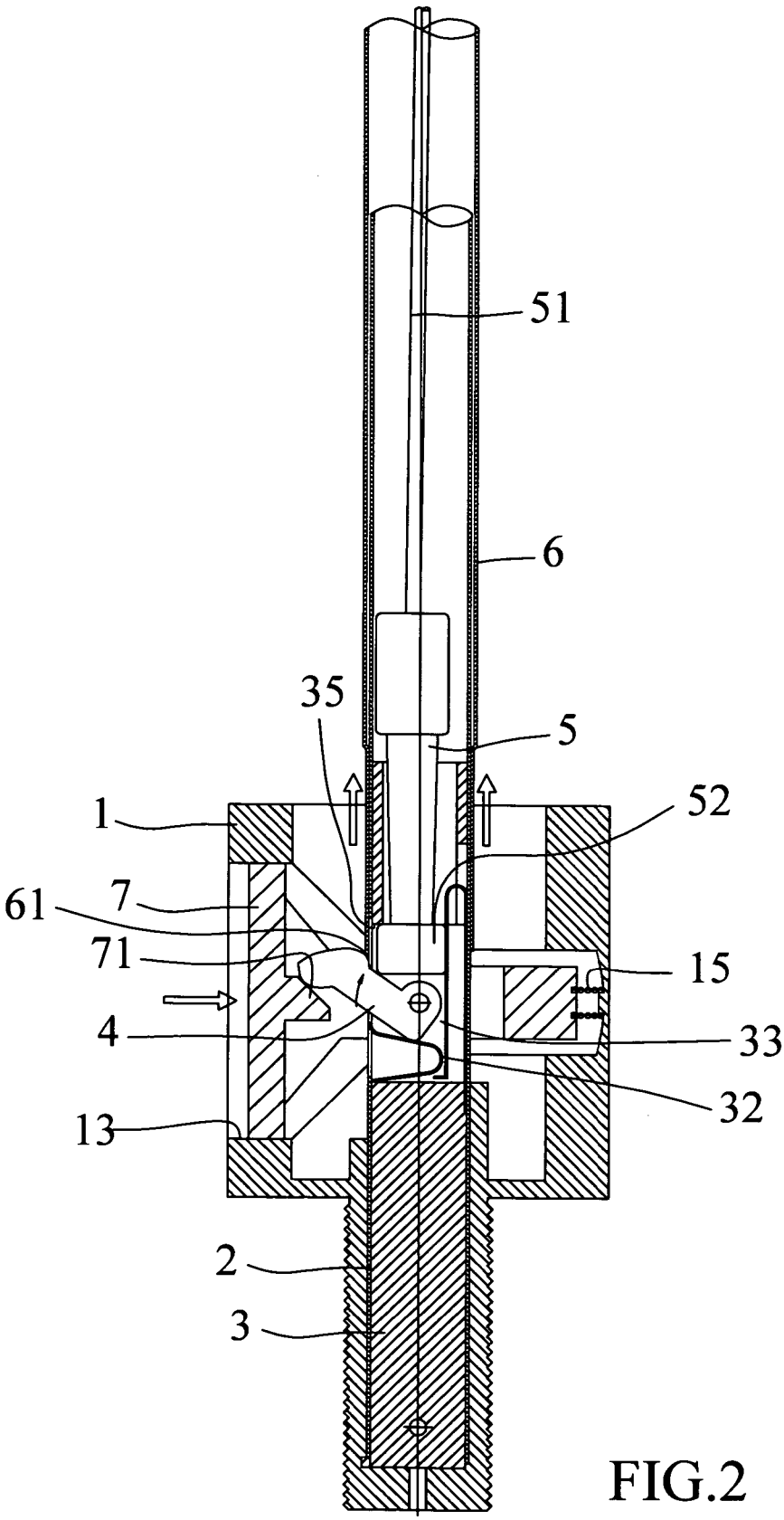
FIG. 2 is a schematic operational view of the control device as shown in FIG. 1.
Figure 3:
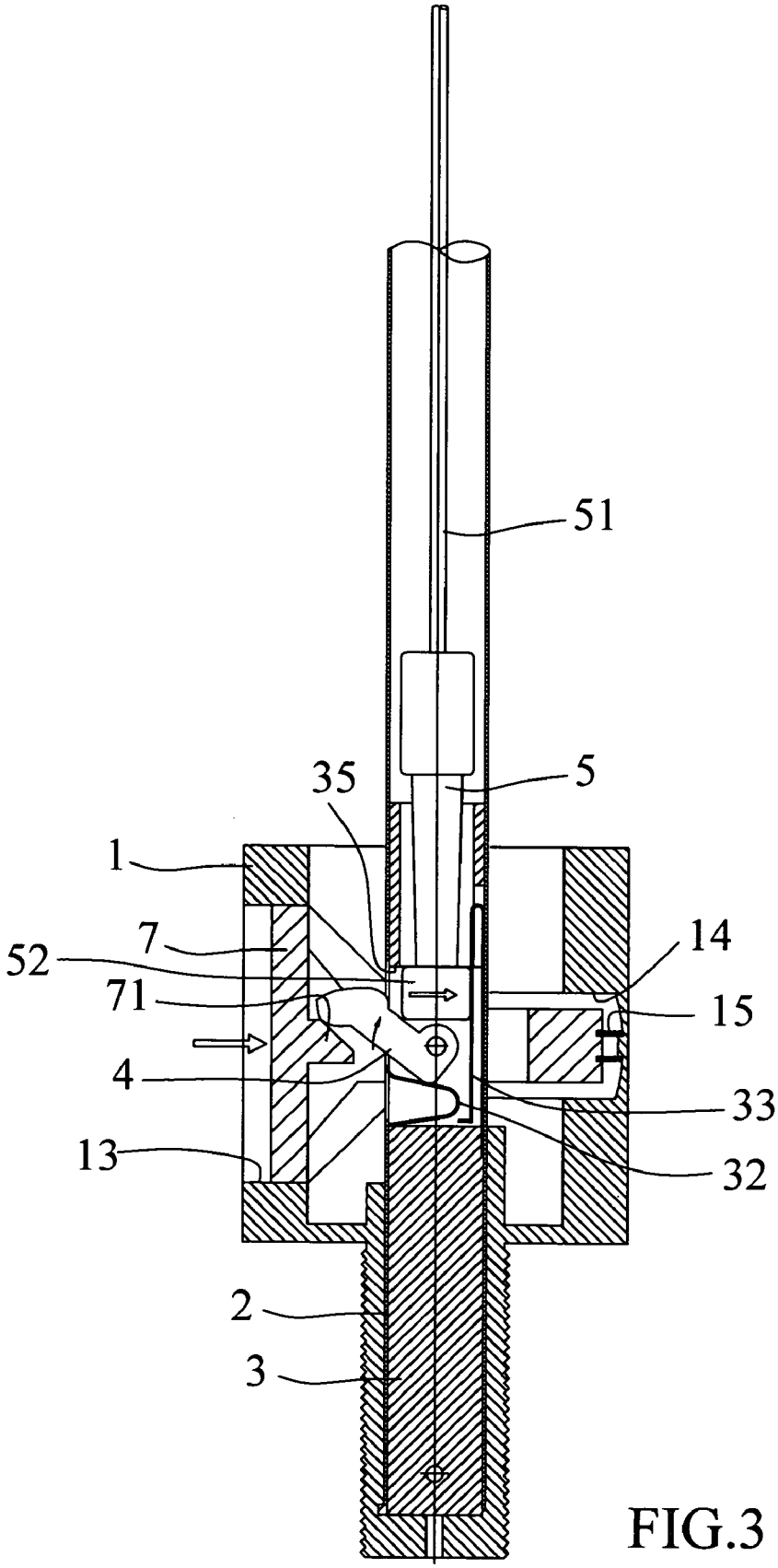
FIG. 3 is a schematic operational view of the control device as shown in FIG. 2.

The push button 7 is movable on the handle 1 between a first position as shown in FIG. 2 where the first end of the press plate 4 is pressed upward by the push block 71 of the push button 7 to push the lower end 61 of the upper tube 6 upward so that the upper tube 6 is moved upward to open the umbrella automatically, and a second position as shown in FIG. 3 where the first end of the press plate 4 is further pressed by the push block 71 of the push button 7 to push the locking portion 52 of the bullet head 5 to detach from the locking hole 35 of the chamber 31 of the control member 3, so that the bullet head 5 is pulled upward by the pull wire 51 to close the umbrella automatically.

In operation, referring to FIGS. 1–4, when the push button 7 is pressed to move inward in the through hole 13 of the handle 1 to the first position as shown in FIG. 2, the first end of the press plate 4 is pressed upward by the push block 71 of the push button 7 to push the lower end 61 of the upper tube 6 upward so that the upper tube 6 is moved upward so as to open the umbrella automatically. At this time, the second elastic plate 32 is urged on the first end of the press plate 4 to push the first end of the press plate 4 upward constantly.

Figure 4:
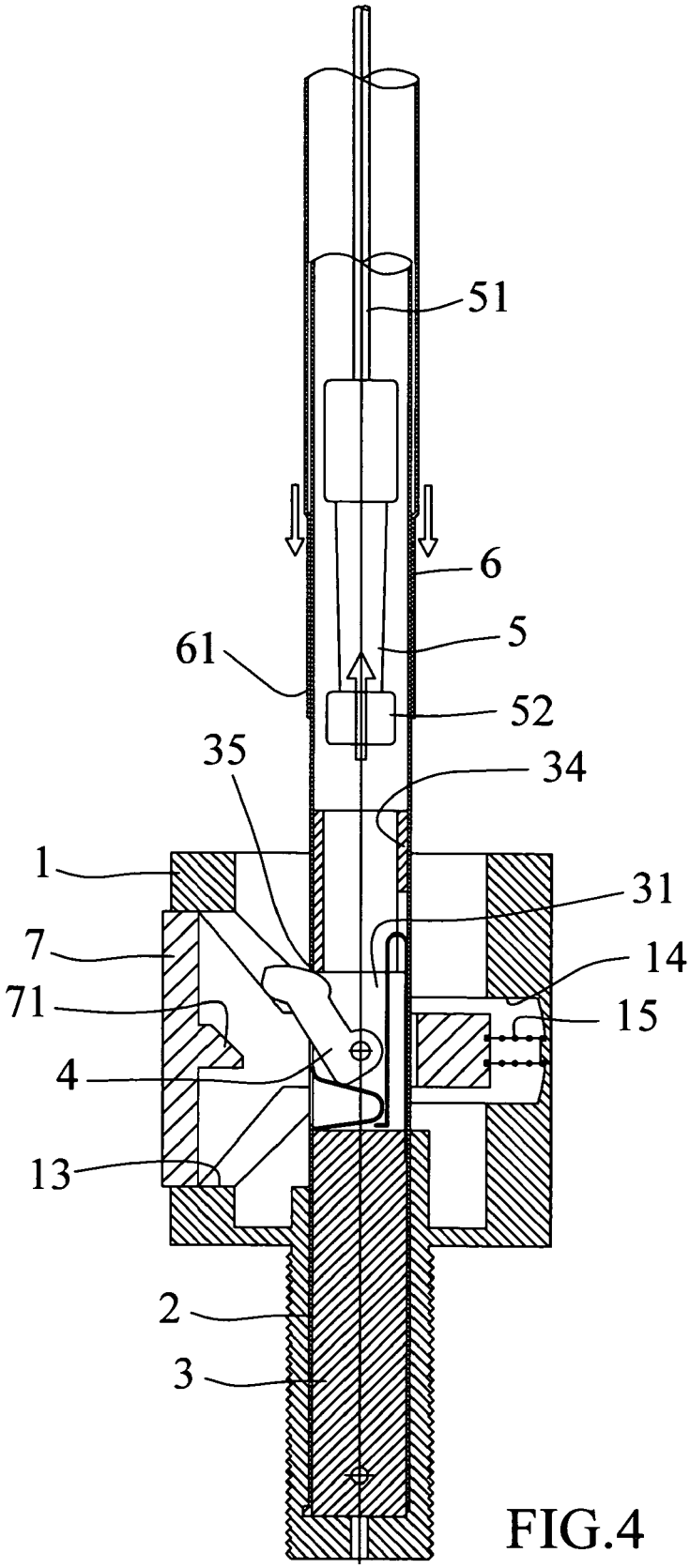
FIG. 4 is a schematic operational view of the control device as shown in FIG. 3.

Alternatively, when the push button 7 is further pressed to move inward in the through hole 13 of the handle 1 to the second position as shown in FIG. 3, the first end of the press plate 4 is further pressed by the push block 71 of the push button 7 to push the locking portion 52 of the bullet head 5 to detach from the locking hole 35 of the chamber 31 of the control member 3, so that the bullet head 5 is pulled upward by the pull wire 51 as shown in FIG. 4 so as to close the umbrella automatically. In addition, the push button 7 is pushed to return to the original position by the restoring force of the restoring member 15.

Accordingly, the push button 7 is pressed in a two-stage manner to push and pivot the press plate 4 to open and close the umbrella automatically, so that the control device is operated easily and conveniently, thereby facilitating a user opening and closing the umbrella. In addition, the push button 7 functions to both open and close the umbrella automatically, thereby facilitating the user operating the control member 3 to open and close the umbrella. Further, the first elastic plate 33 is urged on the locking portion 52 of the bullet head 5 to press the locking portion 52 of the bullet head 5 toward the locking hole 35 of the chamber 31 of the control member 3, so that the locking portion 52 of the bullet head 5 is locked in the locking hole 35 of the chamber 31 of the control member 3 rigidly and stably.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A control device for automatically opening and closing an umbrella comprising a handle, a lower tube, a control member, a press plate, a bullet head, an upper tube, and a push button, wherein:

the handle has a peripheral wall formed with a through hole;

the lower tube is mounted in the handle and has a peripheral wall formed with a through hole aligning with the through hole of the handle;

the control member is mounted in the lower tube and has an inside formed with a chamber having a peripheral wall formed with a locking hole aligning with the through hole of the lower tube;

the bullet head is movably mounted in the control member and the lower tube and has a lower end formed with a locking portion detachably locked in the locking hole of the chamber of the control member;

the upper tube is movably mounted on the lower tube and has a lower end aligning with the locking hole of the chamber of the control member;

the press plate is pivotally mounted on the control member and has a first end protruded outward from the through hole of the lower tube, with the press plate rested on the lower end of the upper tube, with the press plate pushing on the lower end of the bullet head formed with the locking portion;

a first elastic plate and a second elastic plate mounted in the chamber of the control member, with the second elastic plate being urged on the first end of the press plate to push the first end of the press plate upward toward the lower end of the upper tube and the locking portion of the bullet head; and the push button is movably mounted on the handle and has an inner wall formed with a push block rested on the first end of the press plate, wherein the press plate has a second end pivotally mounted to the control member in the chamber of the control member by a pivot shaft.

2. The control device in accordance with claim 1, wherein the handle has an upper end formed with a mounting hole, and the lower tube has an upper end mounted in and protruded from the mounting hole of the handle.

3. The control device in accordance with claim 2, wherein the second end of the press plate is disposed within the lower tube, and wherein the first end of the press plate is extended outwardly from the chamber of the control member through the locking hole of the chamber of the control member and the through hole of the lower tube and extended into the mounting hole of the handle outwardly of the chamber of the control member.

4. The control device in accordance with claim 1, wherein the handle has a lower end formed with an insertion hole, and the lower tube has a lower end inserted into the insertion hole of the handle.

5. The control device in accordance with claim 1, wherein the chamber of the control member aligns with the through hole of the lower tube.

6. The control device in accordance with claim 1, further comprising a fixing rod extended through the lower end of the handle, the lower end of the lower tube and a lower end of the control member to combine the handle, the lower tube and the control member.

7. The control device in accordance with claim 1, further comprising a pull wire extended through the upper tube and the lower tube and having a lower end secured on an upper end of the bullet head to pull the bullet head upward.

8. The control device in accordance with claim 1, wherein the chamber of the control member has an upper end formed with a guide hole, and the bullet head is moved through the guide hole into the chamber of the control member.

9. The control device in accordance with claim 1, further comprising the first elastic plate mounted in the chamber of the control member and urged on the control member and on a side opposite the locking portion of the bullet head to press the locking portion of the bullet head toward the locking hole of the chamber of the control member.

10. The control device in accordance with claim 1, wherein the push block of the push button is wedge-shaped.

11. The control device in accordance with claim 1, wherein the push button is movably mounted in the trough hole of the handle and limited by the lower tube.

12. The control device in accordance wit claim 1, wherein the peripheral wall of the handle is formed with a recess located opposite to the through hole, and the control device further comprises a restoring member mounted in the recess of the handle and biased between an outer wall of the push button and the peripheral wall of the handle.

13. The control device in accordance with claim 7, wherein the push button is movable on the handle between a first position where the first end of the press plate is pressed upward by the push block of the push button to push the lower end of the upper tube upward so that the upper tube is moved upward to open the umbrella automatically, and a second position where the first end of the press plate is further pressed by the push block of the push button to push the locking portion of the bullet head to detach from the locking hole of the chamber of the control member, so that the bullet head is pulled upward by the pull wire to close the umbrella automatically.

* * * * *